US005088614A

United States Patent [19]

Dumestre

[11] Patent Number: 5,088,614

[45] Date of Patent: Feb. 18, 1992

[54] CANNED DRINK COVER APPARATUS

[76] Inventor: Camille Dumestre, P.O. Box 3211, Covington, La. 70433

[21] Appl. No.: 691,440

[22] Filed: Apr. 25, 1991

[51] Int. Cl.[5] ..... A47G 19/22

[52] U.S. Cl. ..... 220/713; 220/711; 220/254; 220/285

[58] Field of Search ..... 220/90.2, 90.4, 90.6, 220/254, 285, 307

[56] References Cited

U.S. PATENT DOCUMENTS 2,839,229 6/1958 Scheswohl ..... 220/90.4 X
3,372,832 3/1968 Yeater et al. ..... 220/254
4,322,014 3/1982 Philip ..... 220/85 SP
4,917,258 4/1990 Boyd et al. ..... 220/240
4,938,379 7/1990 Kellner ..... 220/370

*Primary Examiner*—Stephen P. Garbe
*Assistant Examiner*—Nova Stucker
*Attorney, Agent, or Firm*—Pravel, Gambrell, Hewitt, Kimball & Krieger

[57] ABSTRACT

A drinking spout and cover apparatus affixes to the top of drink cans forming a seal therewith. The user is thus protected from scores on the top of the can. A skirt portion of the cover can be used as a lever to open the tab opening of such drink cans.

5 Claims, 2 Drawing Sheets

CANNED DRINK COVER APPARATUS

BACKGROUND OF THE INVENTION

1. Field of the Invention

The present invention relates to hand held drink dispensers and more particularly relates to a canned drink cover which forms an interface between the consumer and a metal can that contains a canned drink product. More particularly, the present invention relates to an improved canned soft drink cover apparatus that functions as a drinking spout for the user, as a sanitary shield, as well as having a skirt portion that can be used as a lever to aid in the opening of tab type commercially available openings found on drink cans which are aluminum and/or steel.

2. General Background

There are a number of commercially available drink products which are contained in disposable cans that are typically aluminum. These cans are generally cylindrical, having a curved cylindrical side wall, and a flat bottom with a flat top. The can top has a scored portion which surrounds a tab. The tab is manually pulled breaking the top at the score and opening the can. This score can leave sharp edges that can cut the user.

There is a need to provide an interface that can be quickly and simply added to the top of a canned drink product to form a sealed interface therewith and also to allow the user to easily dispense and consume the product therein. Further, the commercially available canned drink products that have a mechanical tab attached to the top of the can and surrounded by a score present problems to many users because the tab is relatively short and not easily opened.

There are a number of patented covers for drink cans which are known to Applicant, U.S. Pat. No. 2,459,558, entitled "Hygienic Protection Applicable To Drinking Vessels For Avoiding Contamination By The Mouth", provides a disk shaped guard formed of a sheet of paper or other material having a notch along one edge which is defined on the disk by two lappings or flaps which are folded in one direction and another fold provided in the other direction and on such a spot that it follows the same curve of the brim of the vessel to which the protector is applied.

The Stafford U.S. Pat. No. 2,693,685, entitled "Sanitary Drinking Attachment For Cans", discloses an article of manufacture which takes the form of a so-called attachment for beer cans and the like and which functions to assist one in drinking directly from the can. The article includes a hold-down tab which assists in retaining the device in position.

The Chevillon U.S. Pat. No. 3,182,393, entitled "Protective Covering", discloses a beverage can cover that can be overlayed about the rim and extending across the top and side of a can. The device is placed over the can before the hole is punched through the can and the cover simultaneously whereby one can drink from the can without touching his lips to the surfaces of the can.

The May U.S. Pat. No. 3,204,805, entitled "Sterile Drinking Container", shows a cover that fits over one end portion of a drink can and includes a tab portion of the protective covering which is removed when the opening tab of the can is lifted. For purposes of showing a commercially available metal tab or pop top tab opening, the May patent is incorporated herein by reference.

The Yeater et al. U.S. Pat. No. 3,372,832, entitled "Removable Cover For Containers", shows a cylindrical cover having a stopper which is pivotally attached thereto. The stopper covers an opening that can be registered over the opening in the drink can.

The Hanisch et al. U.S. Pat. No. 3,438,533, entitled "Protective Cover And Lip Guard For A Can", provides a shipping container for beverages, preferably a can which comprises a can including a cover and having an upper edge formation adapted as a zone useable for drinking and a covering member applied to the upper edge formation and complying with the requirements of hygiene. A removable protective layer is disposed on the top of the covering member.

The Kinoian et al. U.S. Pat. No. 3,690,509, entitled "Hygienic Mouth Protectors", provides a container which has a dispensing opening, the immediate areas adjacent of which are often placed in contact with a human consumer's mouth, the container having a cover over said area of contact, the cover being hygienically bonded to the container to protect the area of contact from being contaminated, the cover having sufficient tear strength to overcome the bond so that the cover can be integrally removed by breaking the bond, for example, by manually pulling the cover away from the container.

A reusable lid for beverage cans is the subject of the Geren U.S. Pat. No. 4,703,873 which provides a detachable lid of plastic construction for the sealed closure of an opened beverage can. Forming the lid is a central body portion surrounded by a downwardly depending double step flange perimeter to accommodate beverage cans of two different diameters. A pour opening located through the body is partially defined on its underside by a downwardly depending spout adapted to penetrate inward of the can opening thereat while being defined topside by an upwardly extending free standing rim of predetermined geometric configuration. A closure cap adapted to cooperate with the pour opening is formed in the free end of an elongated flexible strap secured to the body.

The present invention solves these prior art problems and short comings in a simple straight forward fashion by providing an improved hand drink cover apparatus in the form of a plastic rounded cover having an annular seal that registers with and seals the top of the cylindrical can. The cover features a downwardly extending tab that can be used to open the can and an upwardly extending spout that can be sealed.

SUMMARY OF THE PRESENT INVENTION

The present invention provides a canned drink cover apparatus of an improved configuration that includes a generally circular cover member of a flexible plastic material and having a first annular skirt extending downwardly from the generally circular cover and surrounding the cover at its edge, the downwardly extending skirt forming a seal with the top of the can. The cover provides an opening for dispensing the contents of the can through the opening.

A second skirt portion extends downwardly from the first skirt and around only a portion of the can and terminates circumferentially at a pair of side portions, the second skirt also having a downwardly most bottom portion. A stopper is pivotally mounted to the cover for selectively sealing the dispensing opening. In the preferred embodiment, the stopper includes a rounded stopper portion connected to the cover with a pivot arm and there is further provided a removable connection between the cover and the pivot arm at a position spaced away from the spout. In the preferred embodiment, the second skirt portion angles away from the can and is of a length that is less than the diameter of the cover.

In the preferred embodiment, the first annular shoulder portion has an internal bead that defines a groove for gripping the top portion of the can, forming a seal therewith during use.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
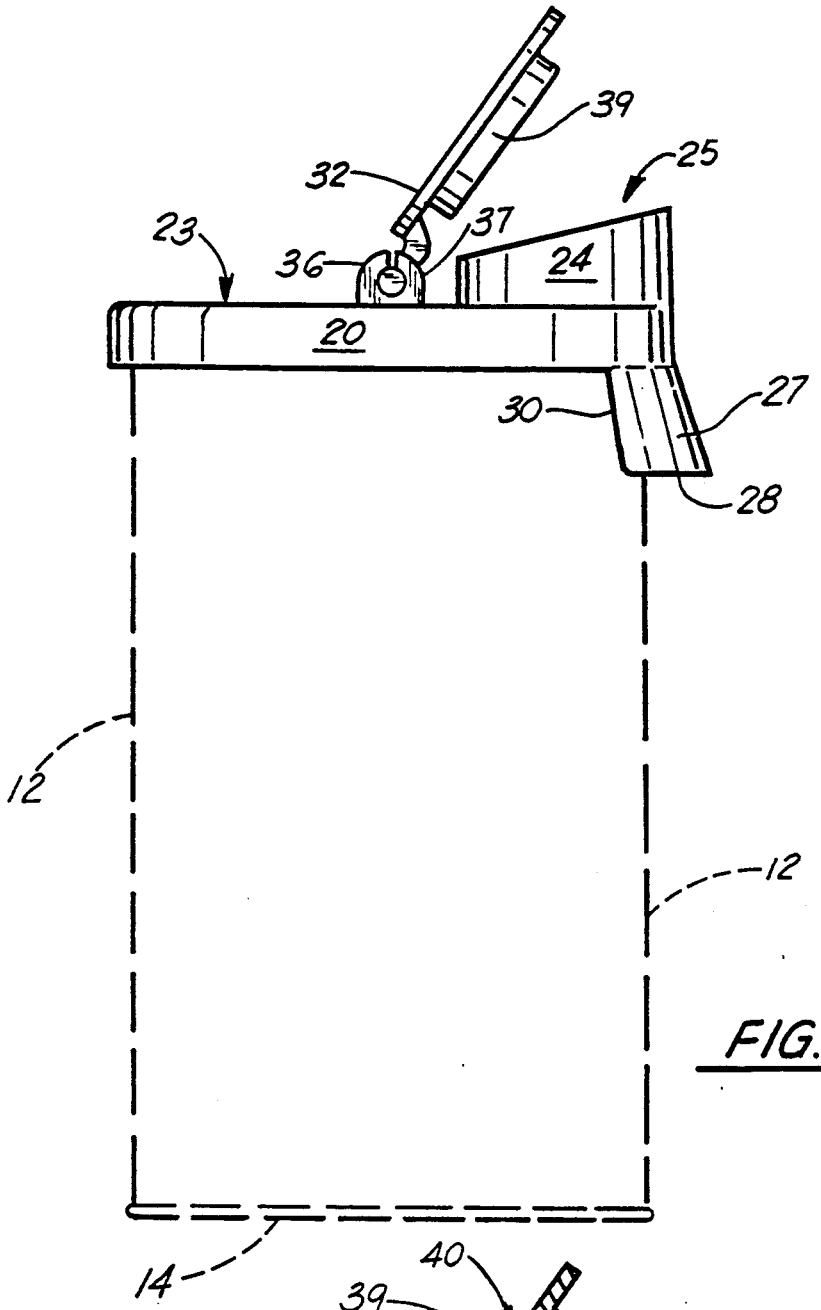
FIG. 1 is a side view of the preferred embodiment of the apparatus of the present invention.
Figure 2:
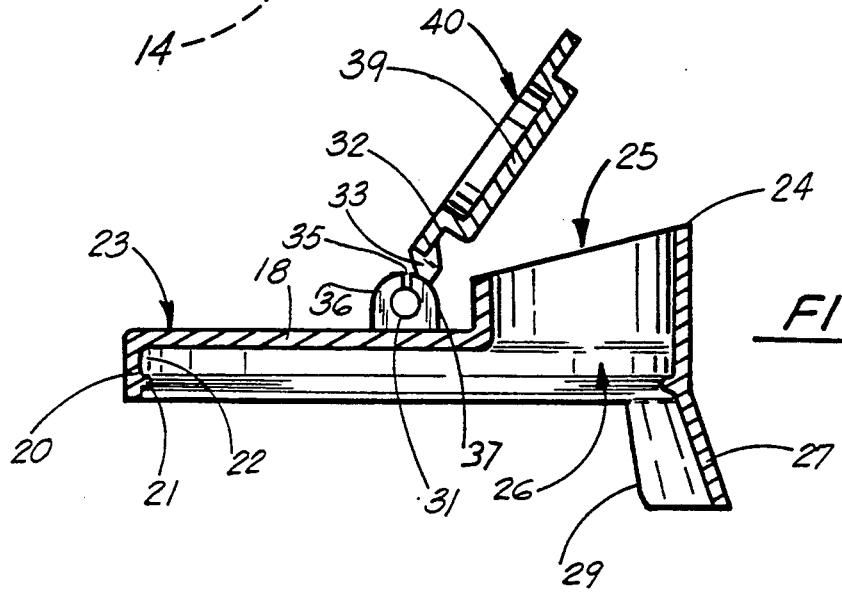
FIG. 2 is a sectional view of the preferred embodiment of the apparatus of the present invention.
Figure 5:
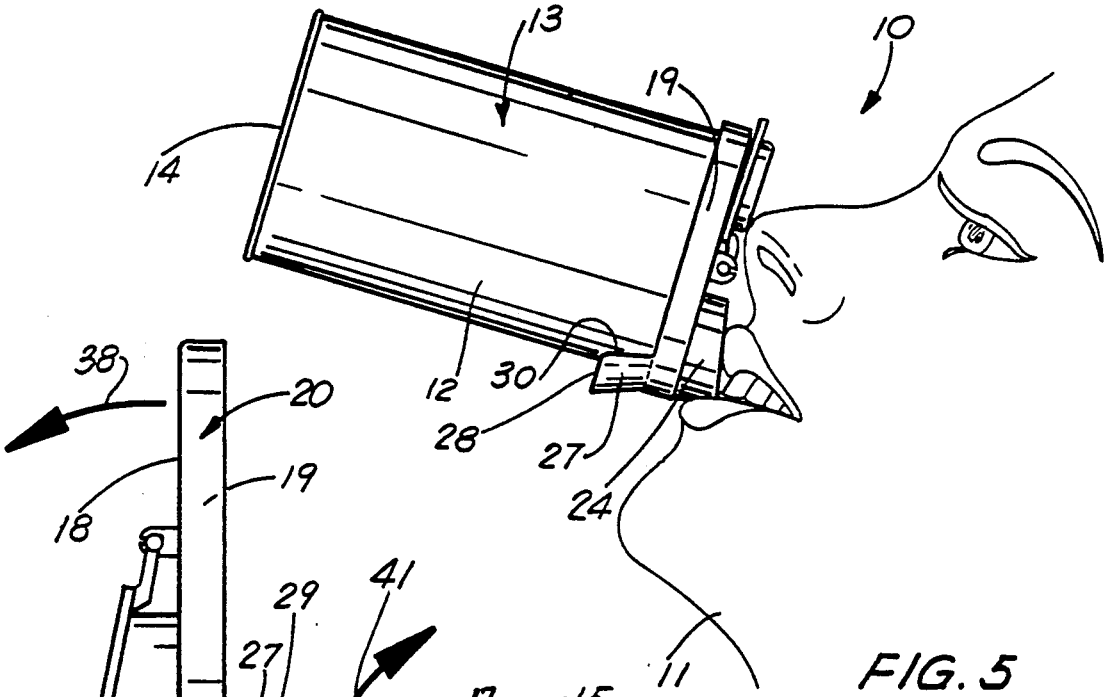
FIG. 5 is a side view of the preferred embodiment of the apparatus of the present invention shown during use.

FIGS. 1-5 illustrate the preferred embodiment of the apparatus of the present invention, designated generally as the numeral 10. In FIGS. 1-5, the user 11 is shown supporting a generally cylindrical metal can 12 that includes a can side wall 13 and a pair of circular can end portions including the bottom 14 and top 15.

The can top portion 15 includes a circular rim 16 to which the cover 10 attaches in the preferred embodiment. Cover 10 includes a generally circular cover 18 having an annular shoulder 19 that extends downwardly from the cover 18. The annular shoulder provides a smooth, generally cylindrical outer side wall surface 20 and provides an internal surface with an annular bead 21 that defines a groove 22 with the cover 18. The cover 18 has a top surface 23 with a spout 24 extending upwardly therefrom. The spout provides an angled dispensing outlet portion 25 communicating with opening 26 that is in the form of an open ended bore that communicates with the underside of the cover and with the top of the spout 24 at the angled dispensing outlet 25.

Figure 3:
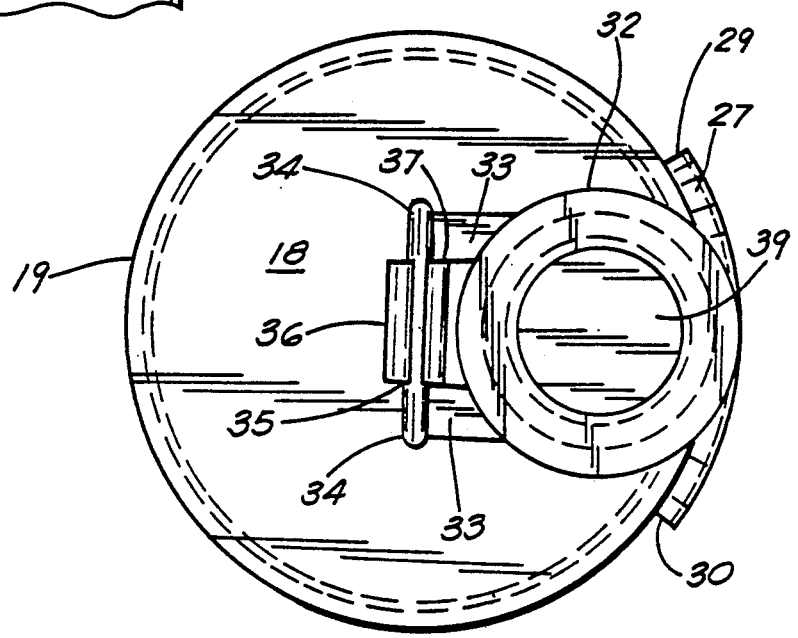
FIG. 3 is a top view of the preferred embodiment of the apparatus of the present invention.

An angled skirt 27 extends downwardly from the annular shoulder 19. The angled skirt 27 has a lower edge 28 and a pair of side edges 29, 30. The edges 29, 30 define a circumferential termination of the angled skirt 27. As can be seen in FIG. 3, the side portions 29, 30 are positioned so that the skirt 27 extends around a portion of the can 13 during use of about 60-90 degrees. The side edges 29, 30 also define the circumferential size of the skirt 27 as extending slightly beyond the diameter of or slightly greater in size than the diameter of the stopper 39 as can be seen in FIG. 3.

The cover 18 has a pivot support 31, preferably integrally formed therewith. A lid structure 32 includes a generally circular stopper 39 having a depression 40 therein so that the stopper fits the spout 24 outlet opening 25. The lid 32 is pivotally moved with respect to the cover 18 upon arms 33 and with transverse shaft 34 being mounted in transverse slot 35 between opposed transverse edge portions 36, 37. However, a single central arm 33 could be supported upon a spaced pair of pivot supports 31.

Figure 4:
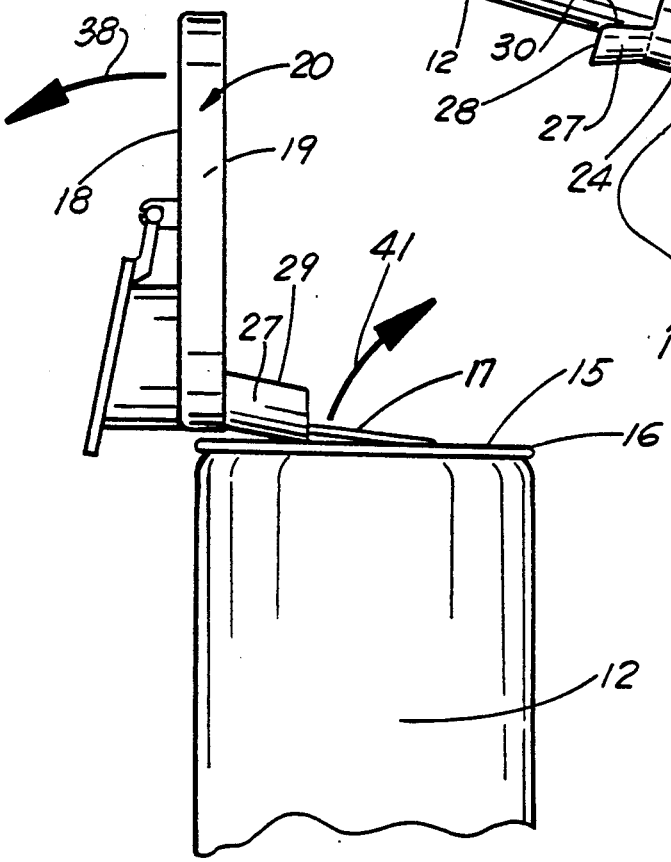
FIG. 4 is a side view of the preferred embodiment of the apparatus of the present invention illustrating its use to open a common drink can.

Arrow 38 in FIG. 4 demonstrates the opening of a tab 17 in can 12, using the cover 18 as a lever as shown in FIG. 3. The cover 18 is moved in a direction as shown by the arrow 38 in FIG. 4. This occurs when the skirt 27 is inserted under the tab 17 so that the skirt 27 forces the tab 17 upwardly in the direction shown by the arrow 41. In this manner, the skirt 27 and the cover 18 function as a lever to pry the tab 17 upwardly, opening the can. The tab and can 17, 13 respectively are commercially available devices.

The below listed table includes parts lists, defining each part number and its description as used herein.

TABLE

PARTS LIST

| Part Number | Description |
|---|---|
| 10 | canned drink cover |
| 11 | user |
| 12 | can |
| 13 | can sidewall |
| 14 | can bottom |
| 15 | can top |
| 16 | circular rim |
| 17 | tab opening |
| 18 | arrow |
| 19 | annular shoulder |
| 20 | outer sidewall surface |
| 21 | annular bead |
| 22 | annular groove |
| 23 | top surface |
| 24 | spout |
| 25 | angled outlet |
| 26 | opening |
| 27 | angled skirt |
| 28 | lower edge |
| 29 | side edge |
| 30 | side edge |
| 31 | pivot support |
| 32 | lid |
| 33 | arm |
| 34 | transverse shaft |
| 35 | transverse slot |
| 36 | transverse edge |
| 37 | transverse edge |
| 38 | arrow |
| 39 | stopper |
| 40 | depression |
| 41 | arrow |

Because many varying and different embodiments may be made within the scope of the invention concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A canned drink cover apparatus for use with a cylindrical drink can, comprising:

a) a generally circular cover member of a flexible plastic material and having a first, annular skirt extending downwardly therefrom and surrounding the cover member and a can and of a size and diameter to be fitted to the top portion of a cylindrical drink can forming a seal therewith;

b) the skirt carrying an internal annular surface that forms a seal with top portion of the can;

c) a dispensing opening in the cover member surrounded by an outlet wall defining a spout that extends away from the cover and the can during use;

d) a second skirt extending downwardly from the first skirt and extending around only a portion of the can and the first annular skirt, terminating circumferentially at a pair of side portions; and e) a stopper pivotally mounted to the cover for selectively sealing the dispensing opening.

2. The apparatus of claim 1, wherein the stopper comprises a rounded stopper connected to the cover with a pivot arm and there is further provided a connection member positioned between the cover and the pivot arm at a position spaced from the spout.

3. The apparatus of claim 1, wherein the second skirt angles away from the can sidewall.

4. The apparatus of claim 1 wherein the second skirt has a bottom edge and the length between the cover and the second skirt bottom edge is less than the diameter of the cover.

5. The apparatus of claim wherein the annular surface has an internal bead that defines a groove for gripping the top portion of the can.

* * * * *